US008058738B1

(12) United States Patent
Bertz

(10) Patent No.: US 8,058,738 B1
(45) Date of Patent: Nov. 15, 2011

(54) POWER GENERATION FOR A CELLULAR TOWER

(75) Inventor: Lyle T. Bertz, Lee's Summit, MO (US)

(73) Assignee: Sprint Communications Company L.P., Overland Park, KS (US)

( * ) Notice: Subject to any disclaimer, the term of this patent is extended or adjusted under 35 U.S.C. 154(b) by 516 days.

(21) Appl. No.: 12/364,995

(22) Filed: Feb. 3, 2009

(51) Int. Cl.
*F01K 15/00* (2006.01)

(52) U.S. Cl. ..... 290/2; 126/692

(58) Field of Classification Search ..... 290/2, 4 C, 290/43, 54; 126/680, 692; 60/641.11
See application file for complete search history.

(56) References Cited

U.S. PATENT DOCUMENTS 4,136,674 A * 1/1979 Korr ..... 126/607
4,777,934 A * 10/1988 De Laquil, III ..... 126/678
7,296,410 B2 * 11/2007 Litwin ..... 60/641.12
7,748,219 B2 * 7/2010 Baker ..... 60/641.2
2005/0126170 A1 * 6/2005 Litwin ..... 60/641.8
2006/0156725 A1 * 7/2006 Kenessey ..... 60/641.12
2008/0011290 A1 * 1/2008 Goldman et al. ..... 126/655
2008/0258473 A1 * 10/2008 McMaster ..... 290/4 R
2009/0212570 A1 * 8/2009 Le et al. ..... 290/52
2010/0164833 A1 * 7/2010 Dalmazzo ..... 343/894
2011/0115226 A1 * 5/2011 Logan et al. ..... 290/52

* cited by examiner

*Primary Examiner* — Thanh Lam

(57) ABSTRACT

Methods and apparatuses are provided for generating electrical power for a cellular tower using solar troughs. Unlike typical long, straight solar troughs, the solar troughs are formed into circular or similar shapes such that they surround the cellular tower radially and are attached to it at different heights. A pipe is located within each solar trough at the focal point of the reflective surface of the trough. A heat-transfer liquid within the pipe is heated by reflected sunlight and flows to an energy-conversion device that converts energy from the heat-transfer liquid into electrical energy to power the cellular tower.

20 Claims, 5 Drawing Sheets

POWER GENERATION FOR A CELLULAR TOWER

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

In one aspect, an apparatus is provided for generating power for a cellular tower. The apparatus includes a monopole cellular tower extending vertically from a stationary base. Solar troughs are formed such that they radially surround the monopole cellular tower and are connected to the tower at different heights. A tube positioned within each of the solar troughs has a heat-transfer liquid flowing through it which is heated by sunlight reflected from the solar trough. The heat-transfer fluid is used by an energy-conversion device to generate electrical power that is stored in a power-storage device and is also delivered to the cellular tower.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
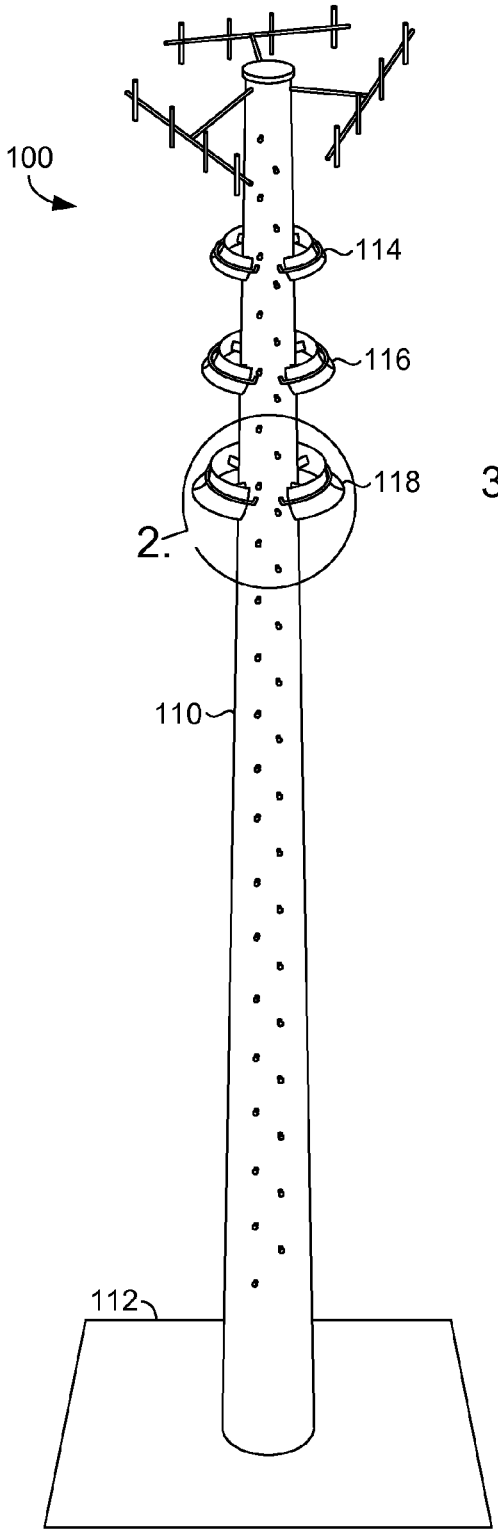
FIG. 1 depicts an illustrative cellular tower implemented in accordance with an embodiment of the present invention.

Embodiments of the present invention provide methods and apparatuses for generating electrical power for a cellular tower. A cellular tower has a number of electrical or electronic systems such as antennas, transmitters, receivers, control electronics, and GPS receivers. Electrical power for a cellular tower is typically supplied via buried electrical cables, an onsite generator, or batteries. Supplying electrical power to a cellular tower installation becomes an issue when the tower is in a remote location or if the terrain is such that digging is difficult. An onsite generator may require fuel to be stored onsite and hauled in. This may be impractical, again due to the remoteness of the cellular tower or difficult terrain.

Another issue with cellular tower installations is the amount of land that must be leased or purchased, and for which access rights must be acquired. Minimizing the amount of land required is desirable. Storing fuel onsite or requiring access to bury cables increases the installation footprint.

Embodiments of the present invention provide a way to generate power for a cellular tower that eliminates the need for onsite storage of generator fuels, or buried cables.

The subject matter of embodiments of the present invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Throughout the description of the present invention, several acronyms and shorthand notations are used to aid the understanding of certain concepts pertaining to the associated system and services. These acronyms and shorthand notations are intended to help provide an easy methodology of communicating the ideas expressed herein and are not meant to limit the scope of the present invention. The following is a list of these acronyms:

| | |
|---|---|
| CD-ROM | Compact Disc read-only memory |
| DVD | Digital Versatile Disc |
| EEPROM | Electrically Erasable Programmable Read-Only Memory |
| GPS | Global Positioning System |
| RAM | Random Access Memory |
| ROM | Read Only Memory |

Further, various technical terms are used throughout this description. An illustrative resource that fleshes out various aspects of these terms can be found in *Newton's Telecom Dictionary* by H. Newton, 24$^{th}$ Edition (2008).

Embodiments of the present invention may be implemented as, among other things: a method, system, or set of instructions embodied on one or more computer-readable media. Computer-readable media include both volatile and nonvolatile media, removable and nonremovable media, and contemplates media readable by a database, a switch, and various other network devices. By way of example, and not limitation, computer-readable media comprise media implemented in any method or technology for storing information. Examples of stored information include computer-useable instructions, data structures, program modules, and other data representations. Media examples include, but are not limited to information-delivery media, RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data momentarily, temporarily, or permanently.

Turning now to FIG. 1, an exemplary apparatus suitable for use in implementing embodiments of the present invention is shown and designated generally as an apparatus 100. Apparatus 100 is one example of a suitable apparatus and is not intended to suggest any limitation as to scope of use or functionality. Neither should apparatus 100 be interpreted as having any dependency or requirement relating to any one or combination of components or modules illustrated.

With continued reference to FIG. 1, one type of cellular tower is a monopole tower 110, which is a single pole that extends vertically upward from a base 112 anchored into the ground. One advantage of the monopole tower 110 is that it has a smaller footprint with respect to other types of towers. Thus, the amount of land required for an installation is minimal. Monopole tower 110 may be composed of individual segments, a single segment, telescoping segments, or any form of monopole tower construction known in the art. In other embodiments of the present invention, other types of towers may be used. For example, another exemplary tower is a self-supporting tower which is well known in the art. Base 112 may be concrete or any material suitable for anchoring monopole tower 110. Base 112 is shown as being rectangular in shape, but may be any suitable shape.

Solar troughs 114, 116, and 118 are located around monopole tower 110 such that each solar trough radially surrounds monopole tower 110. Typically, a solar trough is a long, straight, trough that has or is made of reflective material. The trough is shaped having a parabolic cross-section with a pipe positioned lengthwise within the length trough at the focal point of the parabolic reflective surface. In some cases, the solar trough is motorized such that it moves to capture maximum sunlight as the sun moves through the sky. The trough can be rotated or tilted via a motorized mechanism. In some embodiments, the trough may exist in sections to permit rotation.

Sunlight reflected onto the pipe heats a heat-transfer liquid that flows through the pipe. The heat from the liquid is used generate electrical power using an energy-conversion device. For example, the heat may be used to convert water into steam in order to power a steam turbine generator.

In contrast to the typical solar trough, solar troughs 114, 116, and 118 are shaped such that they surround monopole tower 110 circumferentially and are stacked vertically along the length of the tower. Thus, the array of solar troughs 114, 116, and 118 does not increase the footprint of monopole tower 110. Although exemplary solar troughs 114, 116, and 118 are shown in a circular shape, it is contemplated herein that other shapes or arrangements of solar troughs that surround the tower are within the scope of embodiments of the present invention. For example, solar troughs 114, 116, and 118 may be elliptical, rectangular, triangular, or another shape that surrounds the monopole tower 110.

Solar trough 116 is larger in diameter than solar trough 114 such that the shadow of solar trough 114 does not shade solar trough 116 when the sun is overhead or nearly overhead. Each successively lower solar trough is larger than the one above it for the same reason. In other embodiments, the sizes of the solar troughs 114, 116, and 118 may be identical or may vary.

Figure 4:
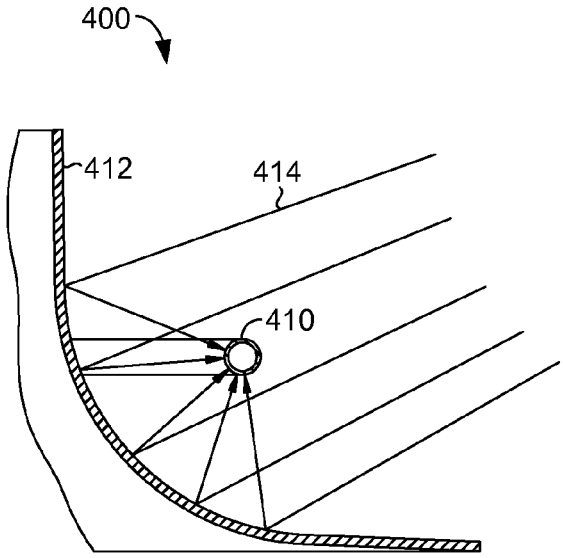
FIG. 4 depicts a vertical cross-sectional view of an illustrative solar trough implemented in accordance with an embodiment of the present invention.

Referring now to FIG. 4, a vertical cross-sectional view of an exemplary solar trough suitable for use in implementing embodiments of the present invention is shown and designated generally as solar trough 400. Solar trough 400 is one example of a suitable solar trough and is not intended to suggest any limitation as to scope of use or functionality. Neither should solar trough 400 be interpreted as having any dependency or requirement relating to any one or combination of components or modules illustrated.

With continued reference to FIG. 4, a pipe 410 is positioned at or near the focal point of a reflective surface 412. Reflective surface 412 may be made of polished aluminum or any reflective material known in the art that reflects a portion or all of the sunlight spectrum. The cross-section of reflective surface 412 may have a parabolic shape as well as other shapes that have been determined to reflect sunlight 414 at or near a specific location (a focal point) within or near the trough. Pipe 410 is located at or near the focal point. Sunlight 414 reflects off of reflective surface 412 and is focused onto pipe 410. The focused sunlight heats pipe 410 and a heat-transfer liquid that flows within it.

Figure 2:
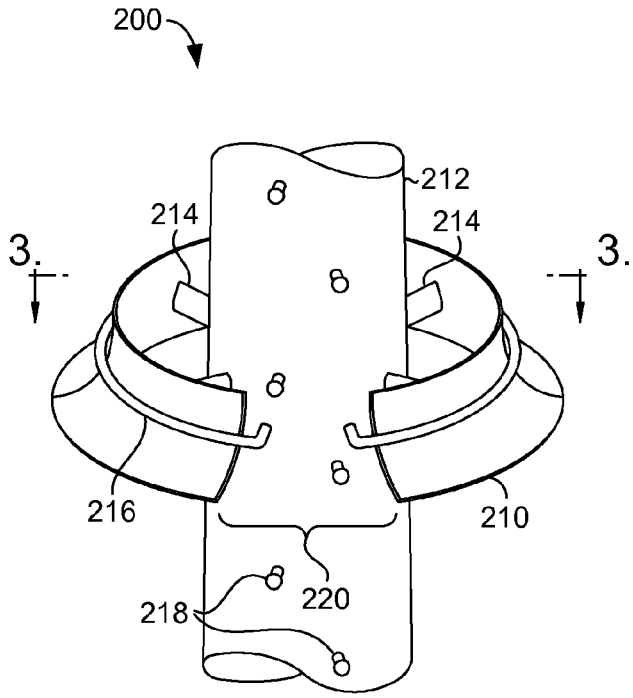
FIG. 2 depicts an illustrative solar trough implemented in accordance with an embodiment of the present invention.

Referring now to FIG. 2, a close-up view of an exemplary apparatus suitable for use in implementing embodiments of the present invention is shown and designated generally as an apparatus 200. Apparatus 200 is but one example of a suitable apparatus and is not intended to suggest any limitation as to scope of use or functionality. Neither should apparatus 200 be interpreted as having any dependency or requirement relating to any one or combination of components or modules illustrated.

With continued reference to FIG. 2, a solar trough 210 is connected to a monopole tower 212 by structural members 214. Structural members 214 are exemplary forms of a connection of solar trough 210 to monopole tower 212, but any form of structural member or connection may be employed to connect solar trough 210 to monopole tower 212. Further, the connection may be rigid such that the position of solar trough 210 is fixed with respect to monopole tower 212. Or, the connection may be moveable such that solar trough 210 may be repositioned on monopole tower 212.

Figure 5:
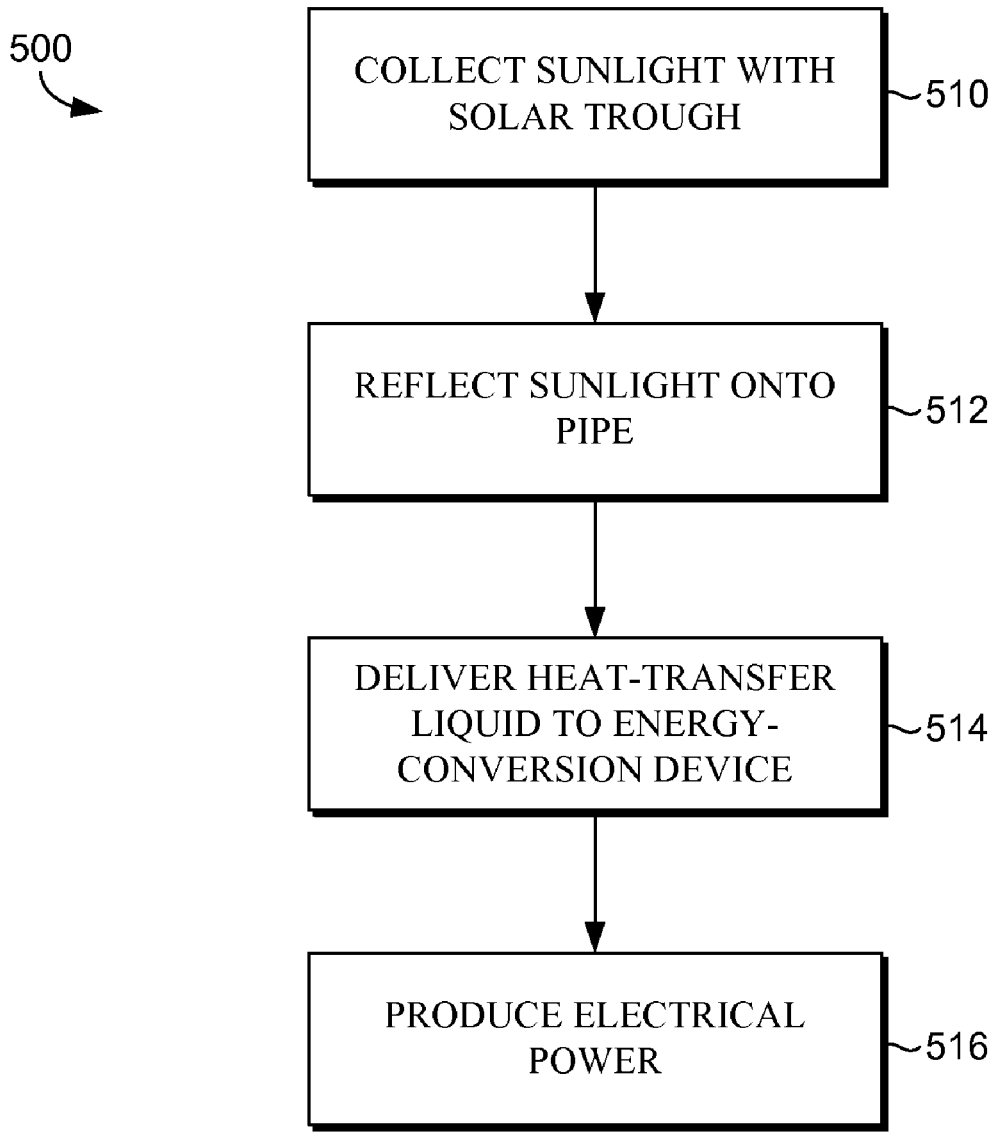
FIG. 5 depicts a flowchart of a process for generating electrical power from sunlight in accordance with an embodiment of the present invention.

Referring to FIG. 5, a flowchart depicts an exemplary method in accordance with an embodiment of the present invention and is designated generally as method 500. Method 500 is one example of a suitable method and is not intended to suggest any limitation as to scope of use or functionality. Neither should method 500 be interpreted as having any dependency or requirement relating to any one or combination of components or modules illustrated.

With continued reference to FIG. 5 and FIG. 2, at a step 510, sunlight is collected using solar trough 210 that radially surrounds monopole tower 110. Monopole tower 212 is but one example of a suitable tower. In embodiments of the present invention, other types of towers may be used.

A tube or pipe 216 is positioned within solar trough 210 at or near the focal point of the reflective portion of solar trough 210. Pipe 216 enters monopole tower 212 near the location of an access ladder 218 in order to provide clearance for a person climbing access ladder 218. In other embodiments of the present invention, pipe 216 may enter monopole tower 212 at other locations, or may not enter monopole tower 212 at all. At a step 512, the collected sunlight is reflected from the surface of solar trough 210 onto pipe 216, which contains a heat-transfer liquid that is heated by the reflected sunlight. At a step 514, the heat-transfer liquid within pipe 216 is delivered to an energy-conversion device. The energy conversion device may be one or more devices or systems that convert heat, pressure, or other forms of energy into electrical energy. In embodiments of the present invention, the energy-conversion device may be located inside monopole tower 212 or any other location such that the heat-transfer liquid may be delivered to it. At a step 516, the energy-conversion device produces electrical power from energy received from the heat-transfer liquid.

Solar trough 210 has a gap 220 in its circumference, such that gap 220 is aligned with access ladder 218 in order to provide clearance for a person climbing access ladder 218. In other embodiments of the present invention, solar trough 210 may be continuous, having no gap, Or, gap 220 may be aligned other than with access ladder 218. Also, solar trough 210 may have multiple gaps.

Figure 3:
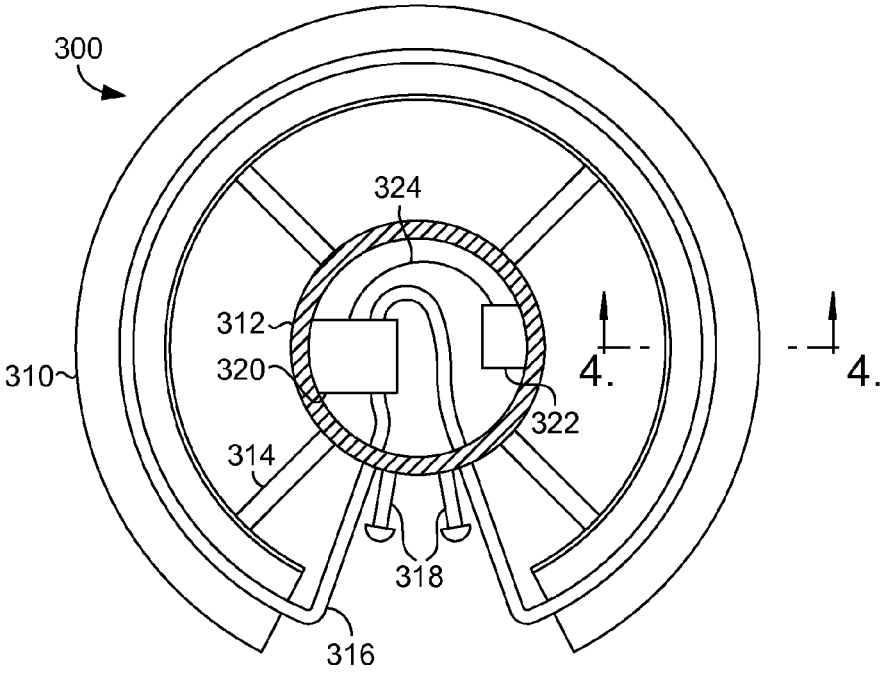
FIG. 3 depicts a top view of an illustrative solar trough implemented in accordance with an embodiment of the present invention.

Referring now to FIG. 3, a top view of an exemplary apparatus suitable for use in implementing embodiments of the present invention is shown and designated generally as an apparatus 300. Apparatus 300 is one example of a suitable apparatus and is not intended to suggest any limitation as to scope of use or functionality. Neither should apparatus 300 be interpreted as having any dependency or requirement relating to any one or combination of components or modules illustrated.

With continued reference to FIG. 3, a solar trough 310 is connected to a monopole tower 312 by structural members 314. A tube or pipe 316 is positioned within solar trough 310 at or near the focal point of the reflective surface of solar trough 310. Pipe 316 enters monopole tower 312 near the location of access ladder 318. Pipe 316 connects with an energy-conversion device 320.

A heat-transfer liquid flows through pipe 316, and is heated by sunlight reflected onto the pipe. The heat-transfer liquid flows to energy-conversion device 320, which converts heat from the heat-transfer liquid into electrical energy. The heat-transfer liquid is circulated through pipe 316 and back through solar trough 310.

Energy-conversion device 320 may be one or more devices or systems that convert energy from the heat-transfer liquid into electrical energy. Exemplary energy-conversion devices are steam turbine generators and thermoelectric generators. In other embodiments of the present invention, energy-conversion device 320 may produce electrical power from a property of the heat-transfer liquid other than heat, such as pressure. Energy-conversion device 320, as shown, is located inside monopole tower 312. In other embodiments of the present invention, energy-conversion device 320 may be located on the exterior of monopole tower 312. Energy conversion device 320 may be placed on the ground, underground, or remotely in another location.

The electrical power generated by energy-conversion device 320 is transferred to a power storage device 322 through an electrical coupling 324. Power storage device 322 may be one or more devices or systems that store electrical power. Power storage device 322, as shown, is located inside monopole tower 312. In other embodiments of the present invention, power storage device 322 may be located on the exterior of monopole tower 312. Power storage device 322 may be placed on the ground, underground, or remotely in another location. The electrical power is used to power electrical and electronic systems associated with monopole cellular 312.

Figure 6:
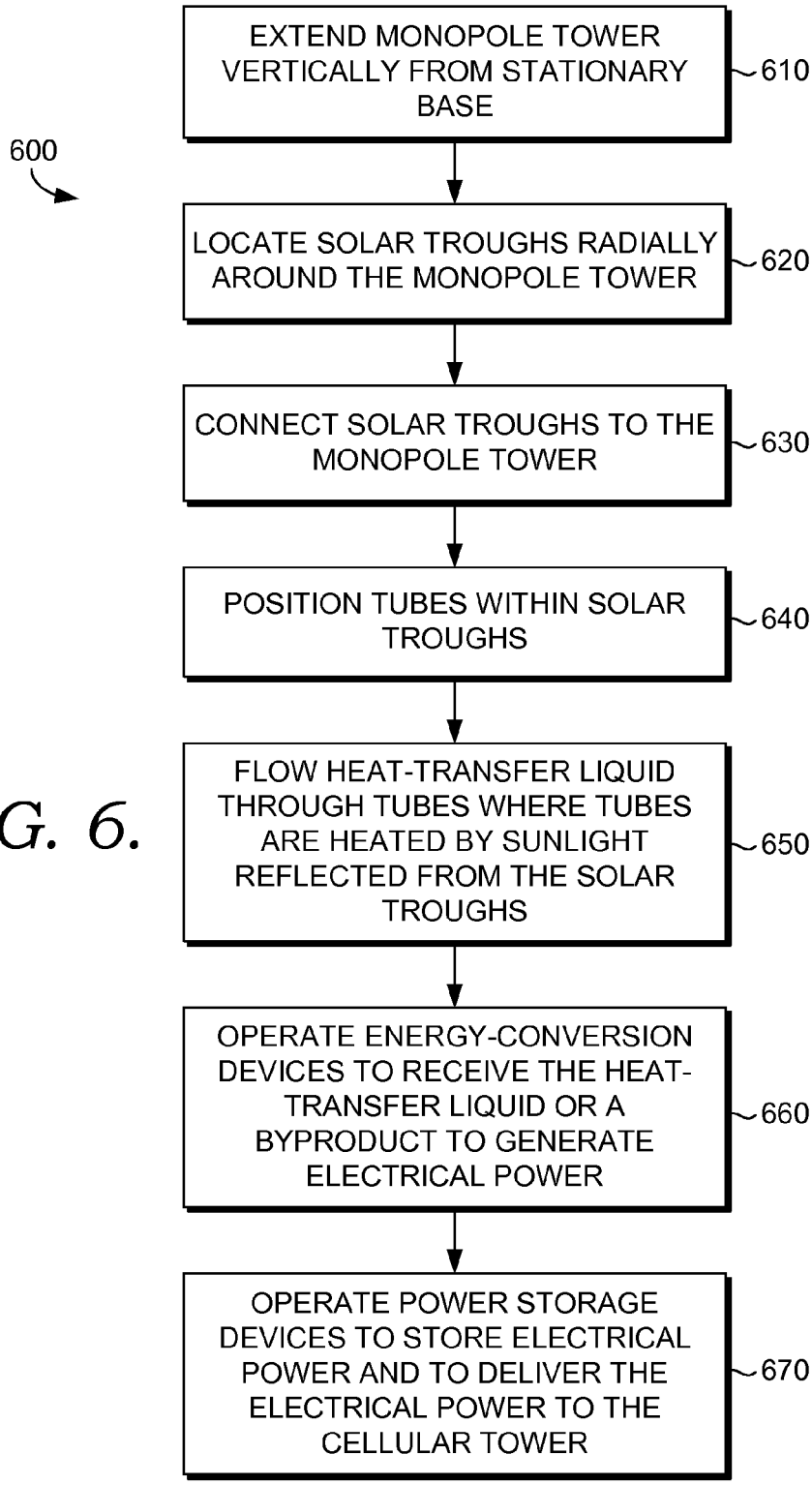
FIG. 6 depicts a flowchart of a process for generating power for a cellular tower in accordance with an embodiment of the present invention.

Referring to FIG. 6, a flowchart is depicted that illustrates a process for generating power for a cellular tower in accordance with an embodiment of the present invention and is designated generally as method 600. Method 600 is one example of a suitable process and is not intended to suggest any limitation as to scope of use or functionality. Neither should method 600 be interpreted as having any dependency or requirement relating to any one or combination of components or modules illustrated.

FIG. 6 will be discussed with reference to FIGS. 1, 2, 3 and 4. With continued reference to FIG. 6, at a step 610, monopole tower 110 is extended vertically from stationary base 112. At a step 620, solar troughs 114, 116 and 118 are located radially around monopole tower 110. At a step 630, solar troughs 114, 116 and 118 are connected to monopole tower 110. The connections may be made using structural members 214 or any type of suitable connection.

At a step 640, tubes 410 are positioned within solar troughs 400. Tubes 410 are positioned at or near the focal points of solar troughs 400 so that sunlight 414 is reflected from the troughs 400 onto the tubes 410. At a step 650, a heat-transfer liquid flows through tubes 410 where the tubes 410 are heated by sunlight. At a step 660, energy conversion devices 320 are operated to receive the heat-transfer liquid or a byproduct to generate electrical power. At a step 670, power storage devices 322 are operated to store electrical power and to deliver the electrical power to the cellular tower.

Figure 7:
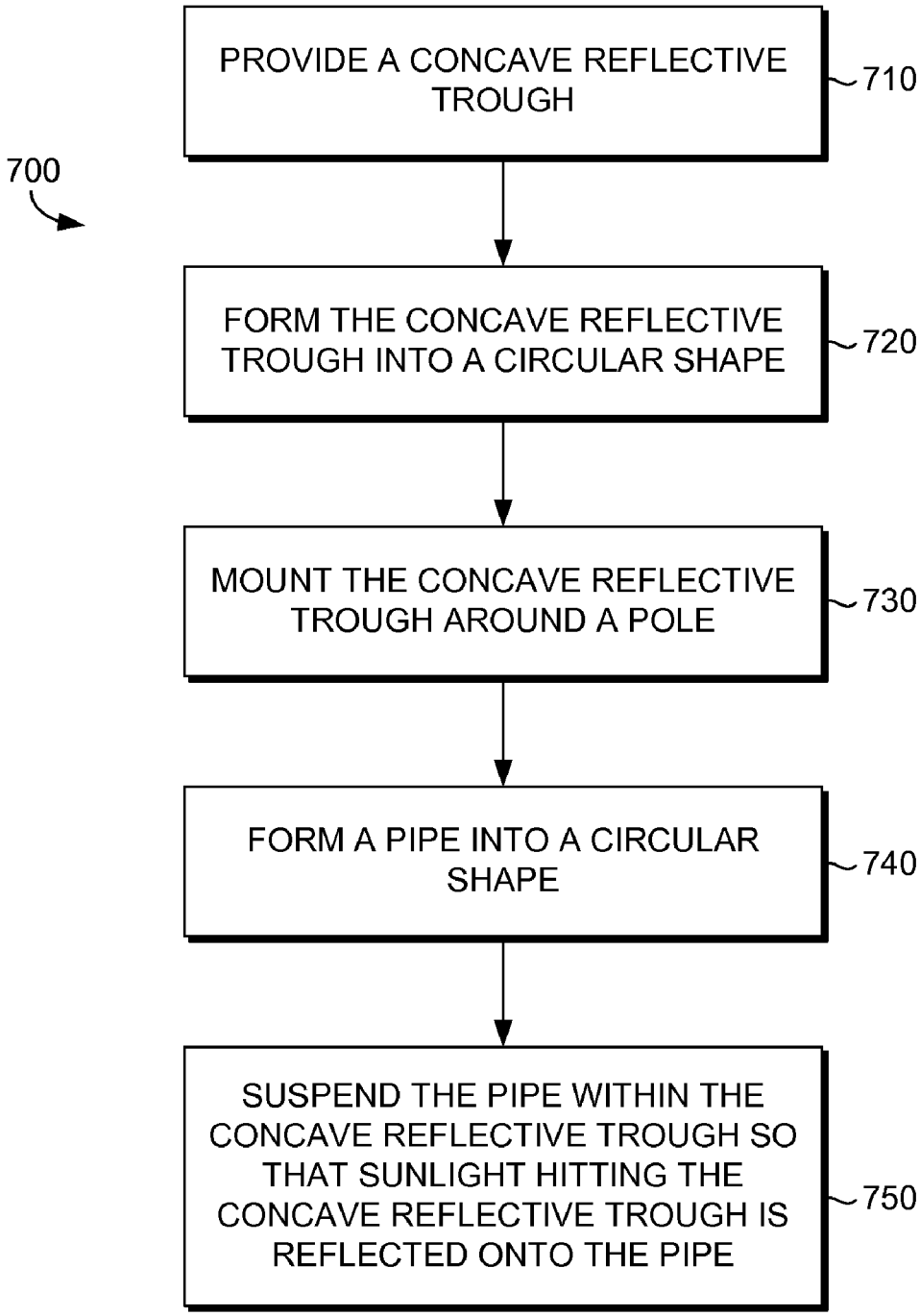
FIG. 7 depicts a flowchart of a process for heating a heat-transfer liquid in accordance with an embodiment of the present invention.

Referring to FIG. 7, a flowchart is depicted that illustrates a process for heating a heat-transfer liquid in accordance with an embodiment of the present invention and is designated generally as method 700. Method 700 is one example of a suitable process and is not intended to suggest any limitation as to scope of use or functionality. Neither should method 700 be interpreted as having any dependency or requirement relating to any one or combination of components or modules illustrated.

FIG. 7 will be discussed with reference to FIGS. 1, 2, 3 and 4. With continued reference to FIG. 7, at a step 710, a concave reflective trough is provided. An exemplary concave reflective trough is a solar trough. The trough may be made of a reflective material, or the concave surface may include, or be coated with, a reflective material. At a step 720, the concave reflective trough is formed into a circular shape. Solar trough 210 is an exemplary concave reflective trough that has been formed into a circular shape.

In a step 730, the concave reflective trough is mounted around a pole, such as monopole tower 110. The concave reflective trough may be attached to the pole using mechanical connections such as structural members 214 or any other type of suitable connection. In a step 740, a pipe is formed into a circular shape. An exemplary pipe formed into the circular shape is pipe 216. In a step 750, the pipe is suspended within the concave reflective trough so that sunlight hitting the concave reflective trough is reflected onto the pipe. In FIG. 4, sunlight 414 reflects off of the concave reflective surface 412 within solar trough 400 and onto pipe 410. The heat-transfer liquid flowing through pipe 410 is heated by sunlight 414 reflected onto pipe 410.

It will be understood that certain features and subcombinations are of utility and may be employed without reference to other features and subcombinations and are contemplated within the scope of the claims. Not all steps listed in the various figures need be carried out in the specific order described.

The invention claimed is:

1. An apparatus for generating power for a cellular tower, comprising:

a monopole tower extending vertically from a stationary base;

one or more solar troughs located around the monopole tower wherein each of the one or more solar troughs radially surrounds the monopole tower and wherein the one or more solar troughs are connected to the monopole tower;

one or more tubes positioned within each of the one or more solar troughs, wherein a heat-transfer liquid flowing through the one or more tubes is heated by sunlight reflected from the one or more solar troughs;

one or more energy-conversion devices for receiving the heat-transfer liquid or a byproduct of the heat-transfer liquid to generate an electrical power; and one or more power storage devices for storing the electrical power and for delivering the electrical power to the cellular tower.

2. The apparatus of claim 1, wherein the one or more solar troughs have different diameters from each other and are connected to the monopole tower at different heights such that the diameter of a first solar trough is smaller than the diameter of a second solar trough immediately below it.

3. The apparatus of claim 2, wherein an access ladder is attached to the monopole tower.

4. The apparatus of claim 3, wherein the one or more energy-conversion devices is at least one of a steam turbine, a steam engine and a thermoelectric generator.

5. A method for generating electrical power from sunlight, comprising:

collecting the sunlight with one or more solar troughs that radially surround a tower;

reflecting the sunlight that is collected from the one or more solar troughs onto one or more pipes containing a heat-transfer liquid, whereby the heat-transfer liquid is heated;

delivering the heat-transfer liquid to one or more energy-conversion devices; and producing the electrical power from the heat transfer liquid with the one or more energy-conversion devices.

6. The method of claim 5, wherein the one or more solar troughs are connected to the tower at different heights above a base of the tower.

7. The method of claim 6, wherein the one or more solar troughs have different diameters with respect to each other and the diameter of each solar trough is smaller than the diameter of the solar trough immediately below it.

8. The apparatus of claim 7, wherein a gap in a circumference of the one or more solar troughs is aligned with a ladder attached to the tower, such that the gap provides clearance for a person climbing the ladder.

9. The method of claim 8, further comprising storing the electrical power in one or more power storage devices.

10. The method of claim 9, further comprising supplying the electrical power to the tower, wherein the tower is a cellular tower.

11. An apparatus for heating a heat-transfer liquid, comprising:

a concave reflective trough, wherein the concave reflective trough is formed into a circular shape wherein the concave reflective trough is adapted to be mounted circumferentially around a pole; and a pipe formed into a circular shape and suspended within the concave reflective trough such that sunlight incident upon the concave reflective trough is reflected onto the pipe.

12. The apparatus of claim 11, wherein a concave portion of the concave reflective trough faces outward from a center point of the circular shape.

13. The apparatus of claim 12, wherein a heat transfer liquid that flows through the pipe is heated by the sunlight reflected onto the pipe.

14. The apparatus of claim 13, further comprising an energy-conversion device, whereby energy from the heat-transfer liquid is converted into electrical energy.

15. The apparatus of claim 14, further comprising one or more energy storage devices for storing the electrical energy.

16. The apparatus of claim 15, wherein the pole is a monopole cellular tower.

17. The apparatus of claim 16, wherein the electrical energy is supplied as electrical power to the monopole cellular tower.

18. The apparatus of claim 17, further comprising a plurality of concave reflective troughs mounted at different heights on the monopole cellular tower.

19. The apparatus of claim 18, wherein a diameter of each of the plurality of concave reflective troughs is varied such that the diameter of each concave reflective trough is smaller than the diameter of the concave reflective trough immediately below it.

20. The apparatus of claim 19, wherein an access ladder is attached to the monopole cellular tower.

* * * * *